US011774118B2

(12) United States Patent
Langford

(10) Patent No.: US 11,774,118 B2
(45) **Date of Patent: *Oct. 3, 2023**

(54) CONCEALED ROOF VENT AND METHOD OF USE

(71) Applicant: Joseph Langford, St. George, UT (US)

(72) Inventor: Joseph Langford, St. George, UT (US)

( * ) Notice: Subject to any disclaimer, the term of this patent is extended or adjusted under 35 U.S.C. 154(b) by 309 days.

This patent is subject to a terminal disclaimer.

(21) Appl. No.: 17/210,476

(22) Filed: Mar. 23, 2021

(65) Prior Publication Data

US 2021/0207824 A1 Jul. 8, 2021

Related U.S. Application Data

(63) Continuation of application No. 15/476,541, filed on Mar. 31, 2017, now Pat. No. 10,955,155.

(60) Provisional application No. 62/315,764, filed on Mar. 31, 2016.

(51) Int. Cl.
*F24F 7/02* (2006.01)

(52) U.S. Cl.
CPC ..... *F24F 7/02* (2013.01); *F24F 2221/26* (2013.01)

(58) Field of Classification Search
CPC ..... F24F 7/02; F24F 2221/26
USPC ..... 454/367
See application file for complete search history.

(56) References Cited

U.S. PATENT DOCUMENTS

| | | | | |
|---|---|---|---|---|
| 5,630,752 | A * | 5/1997 | Gubash | F24F 7/02 454/366 |
| 6,491,579 | B1 * | 12/2002 | O'Hagin | E04D 1/30 454/339 |
| 6,530,189 | B2 * | 3/2003 | Freshwater | E04D 13/002 52/DIG. 9 |
| 2008/0299892 | A1 * | 12/2008 | Robinson | F24F 7/02 454/339 |
| 2011/0030293 | A1 * | 2/2011 | Trischan | E04D 13/17 52/199 |
| 2015/0343247 | A1 * | 12/2015 | Daniels | F24F 7/02 454/366 |

* cited by examiner

*Primary Examiner* — Avinash A Savani
*Assistant Examiner* — Dana K Tighe
(74) *Attorney, Agent, or Firm* — Gurr Brande & Spendlove, PLLC; Robert A. Gurr

(57) ABSTRACT

A concealed roof vent has a base member having a primary aperture, a top panel coupled to the rear side of the base member and extending to the front side of the base member at an increasing angle, the top panel sized so as to shield the primary aperture; the top panel being coupled to the front side of the base member using one or more support legs; and at least one secondary aperture on the front side between the panel and the base member. Air from the attic passes through the primary aperture to the secondary aperture, through channels on the underside of roofing tiles, and to the atmosphere.

1 Claim, 16 Drawing Sheets

CONCEALED ROOF VENT AND METHOD OF USE

CROSS-REFERENCE TO RELATED APPLICATIONS

This application is a continuation of U.S. Non-Provisional application Ser. No. 15/476,541, filed on Mar. 31, 2017, which claimed the benefit of U.S. Provisional Application Ser. No. 62/315,764, filed on Mar. 31, 2016, both of which are incorporated herein by reference.

TECHNICAL FIELD

The present disclosure relates to roof vents. More particularly, the present disclosure is directed to passive attic vents for tile roofs.

BACKGROUND

The need to vent the attic of a building is well known and has been done in the prior art for years. For example, gable vents and dormer type passive ventilation systems are common. However, these systems are clearly visible and reduce the aesthetics of the structure. Further, passive vents have been marketed and used for some time, including what are referred to as "camouflage" vents—or those that are meant to blend into the appearance of the roof. However, these camouflage vents have had several shortcomings, such as the ability of driven rain or snow to enter the vent, or the lack of the vent to be properly camouflaged into the surrounding roof tiles. The venting systems on the market directly expose a portion of the vent. As such, the prior art has yet to create a vent that is completely concealed while remaining effective. Therefore, there remains a need for a roof vent that not only is concealed, but that can adequately provide for ventilation of the attic, while at the same time restricting the entry of various types of moisture or other unwanted items.

Further, there exists a need for a vent that can solve not only the above problems, but one that can also be used with various tiles, such as flat tiles, Spanish S-tiles, Double Roman tiles, and others. The present invention seeks to solve these, and other, problems.

SUMMARY OF EXAMPLE EMBODIMENTS

In one embodiment, a concealed roof vent comprises a base member having a primary aperture, wherein a screen is fastened to a first side of the base member and configured to cover the primary aperture; a panel coupled to the rear side of the base member and extending to the front side of the base member at an increasing angle, the panel sized so as to shield the primary aperture; the panel being coupled to the front side of the base member using one or more support legs; and at least one secondary aperture on the front side between the panel and the base member.

In one embodiment, a method of concealing a roof vent comprises placing the rear side of the concealed roof vent at a higher point on the pitch of a roof, with the front side being at the lower end of the pitch, the primary aperture in the base member being placed directly over an aperture in the roof so as to allow air to flow from the attic through the aperture in the roof and the primary aperture and screen of the base member, placing one or more roof tiles over the concealed roof vent, the tiles configured to have one or more channels therein so as to allow air to flow from the primary aperture through the secondary aperture, and through the channels in the tile to the outside.

In one embodiment, a system of concealing roof vents comprises one or more tiles having channels on the underside of the tile, the tiles being placed over a concealed roof vent so as to conceal the vent from view; the concealed roof vent comprising a primary aperture and configured to allow the egress of air from an aperture in the roof, through the primary aperture, and through the channels in the tile.

DETAILED DESCRIPTION OF EXAMPLE EMBODIMENTS

Figure 1A:
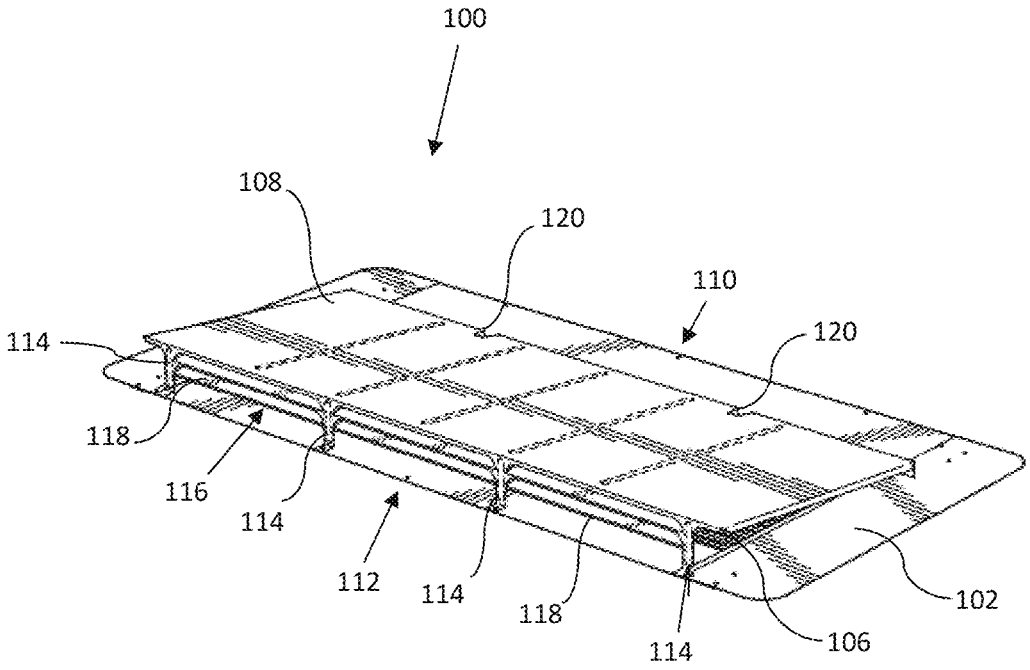
FIG. 1A is a perspective view of a concealed roof vent.
Figure 1B:
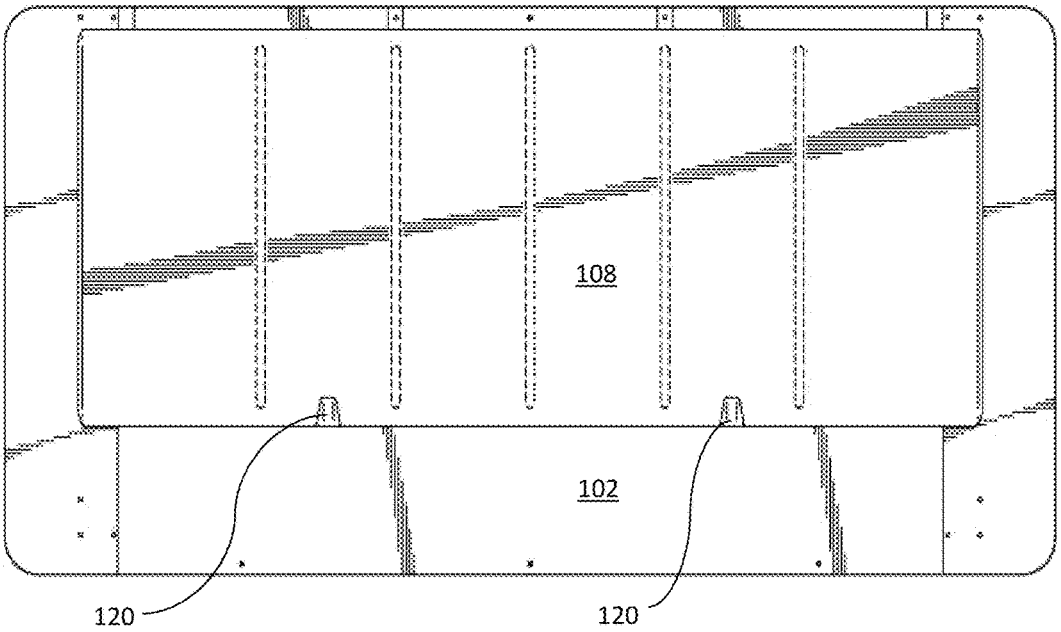
FIG. 1B is a top plan view of a concealed roof vent.
Figure 1C:
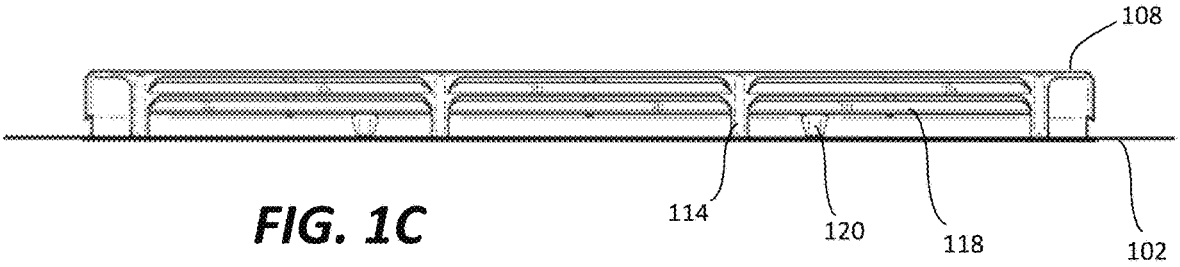
FIG. 1C is a front elevation view of a concealed roof vent.
Figure 1D:
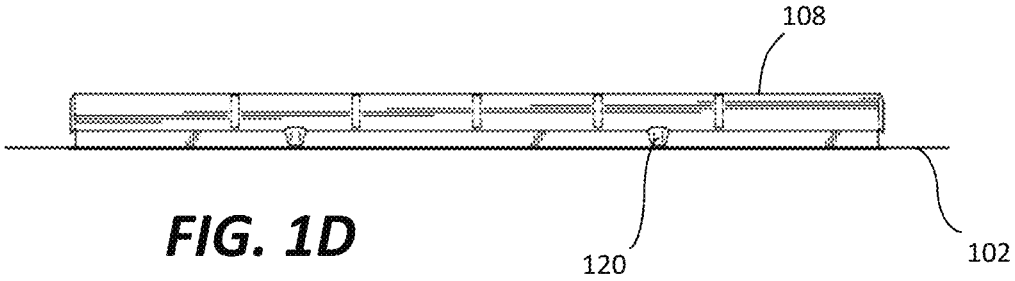
FIG. 1D is a rear elevation view of a concealed roof vent.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiment," and the like, may indicate that the embodiment(s) so described may include a particular feature, structure, or characteristic, but not every embodiment necessarily includes the particular features, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may. Further, not all drawings may be drawn to scale.

Accordingly, the particular arrangements disclosed are meant to be illustrative only and not limiting as to the scope of the invention. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed process or methods generally may be carried out in various different sequences and arrangements while still falling within the scope of the present invention.

The term "coupled" may mean that two or more elements are in direct physical or electrical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

It will be appreciated from the following disclosure that the concealed roof tile solves the need for a roof vent that is completely concealable while still allowing efficient air flow.

Figure 1E:
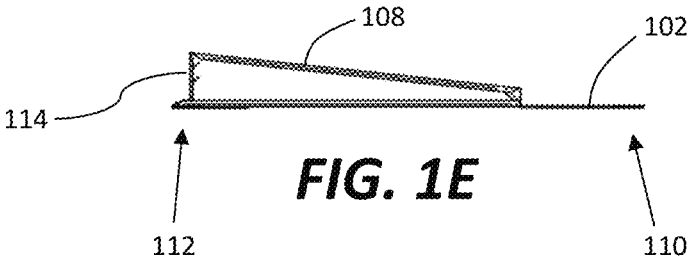
FIG. 1E is a side elevation view of a concealed roof vent.
Figure 1F:
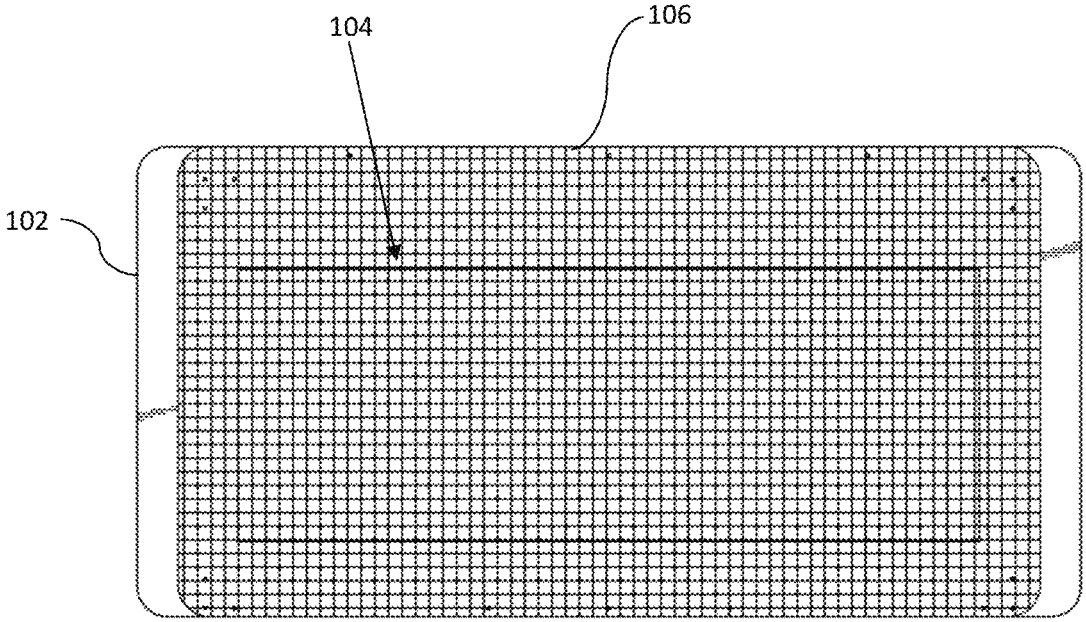
FIG. 1F is a bottom plan view of a concealed roof vent.
Figure 2A:
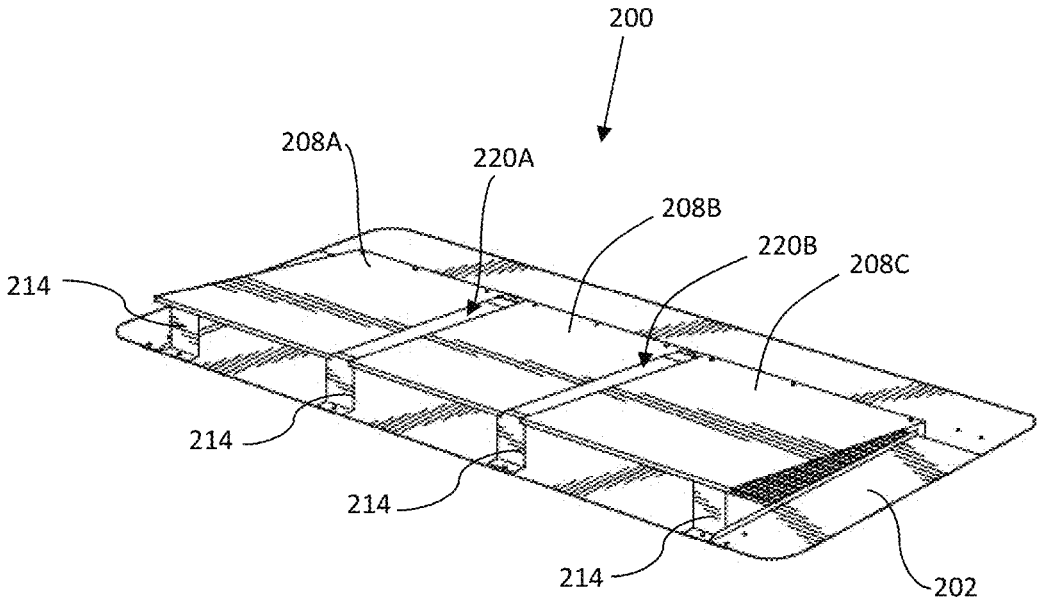
FIG. 2A is a perspective view of a concealed roof vent.
Figure 2B:
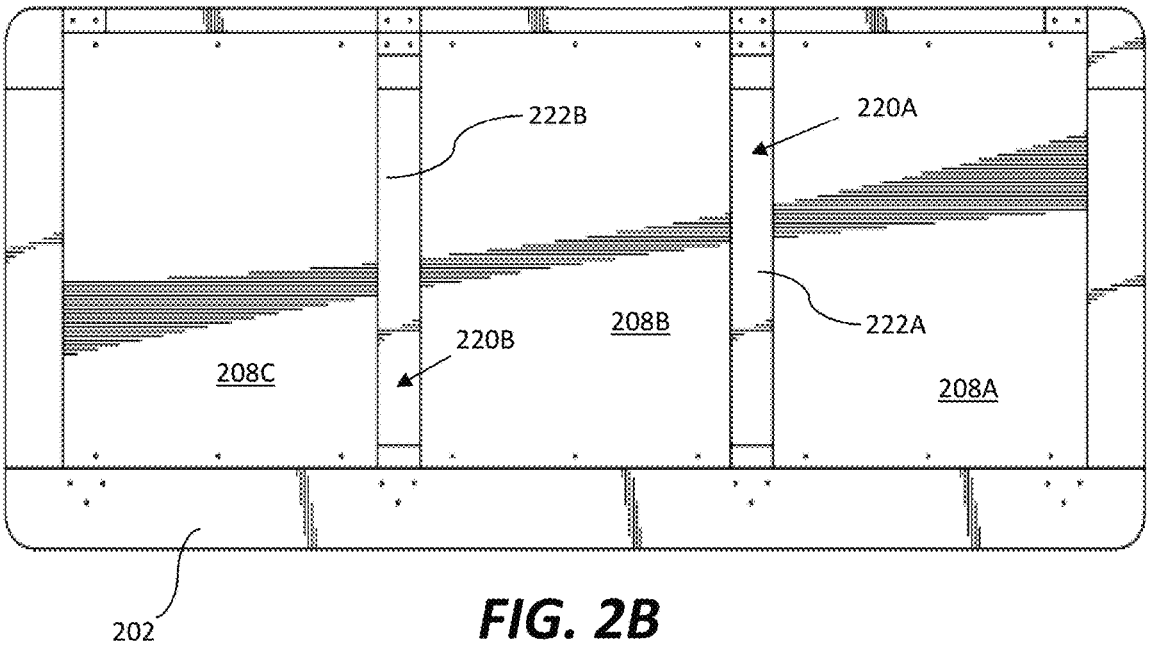
FIG. 2B is a top plan view of a concealed roof vent.
Figure 2C:
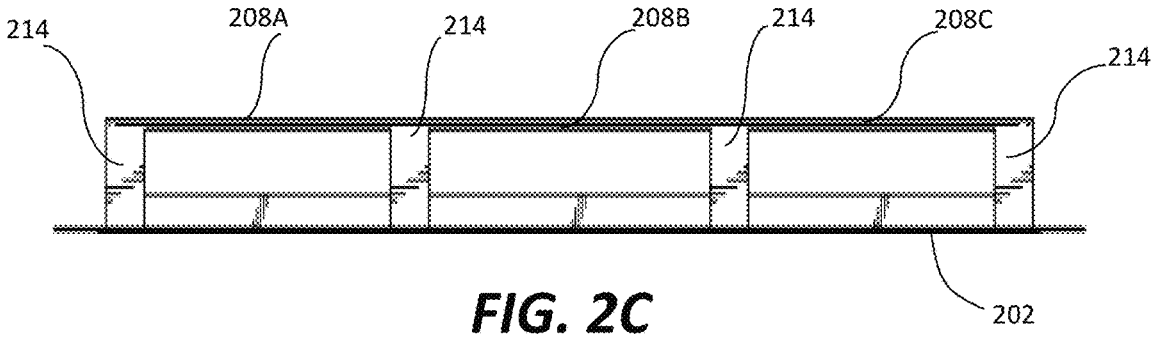
FIG. 2C is a front elevation view of a concealed roof vent.
Figure 2D:
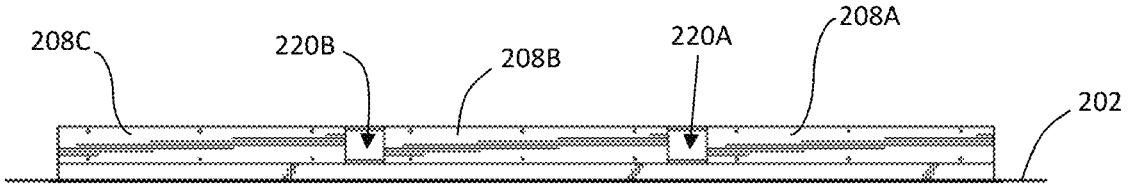
FIG. 2D is a rear elevation view of a concealed roof vent.
Figure 2E:
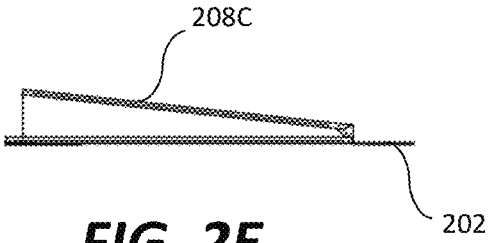
FIG. 2E is a side elevation view of a concealed roof vent.
Figure 2F:
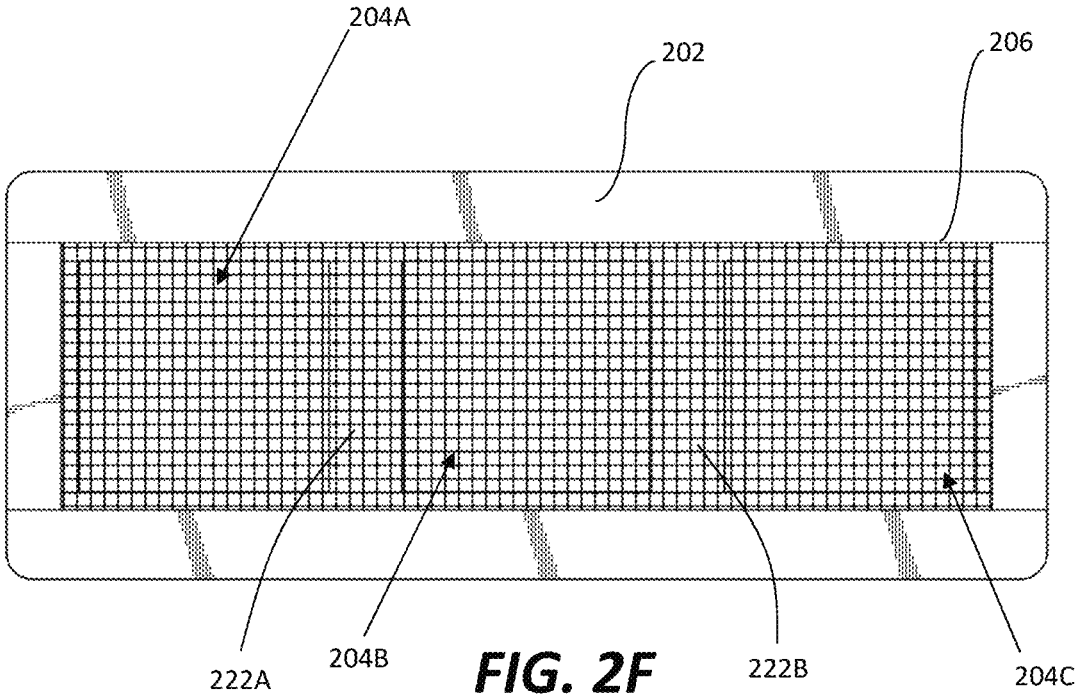
FIG. 2F is a bottom plan view of a concealed roof vent.
Figure 3A:
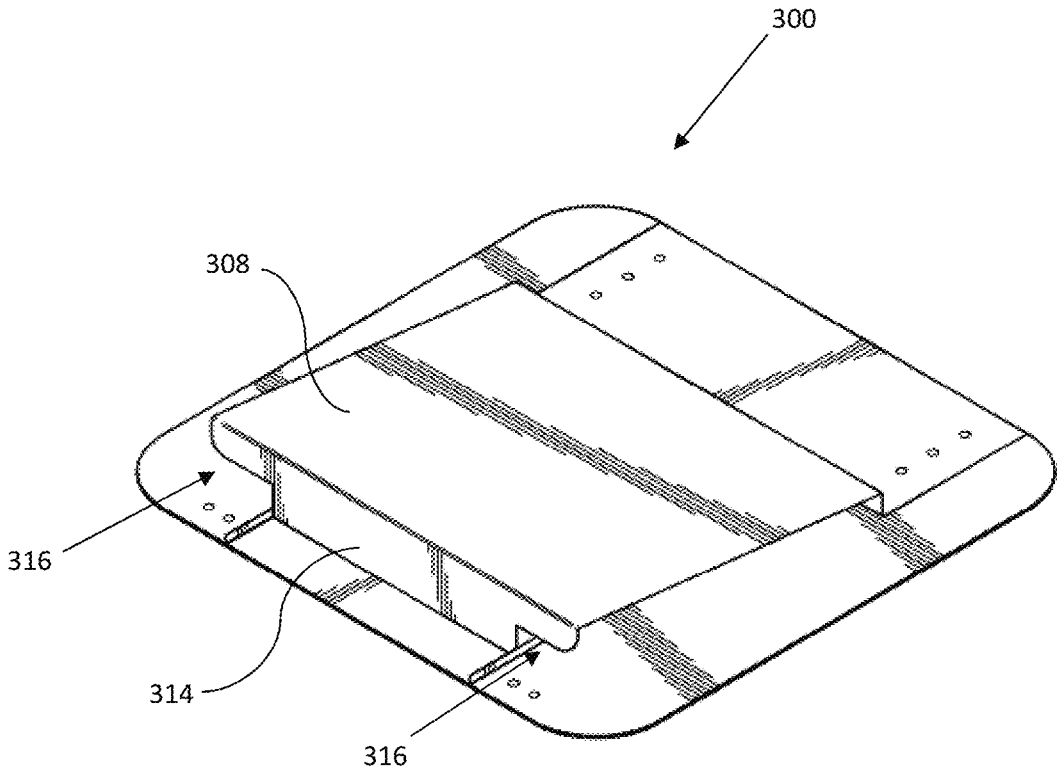
FIG. 3A is a perspective view of a concealed roof vent.
Figure 3B:
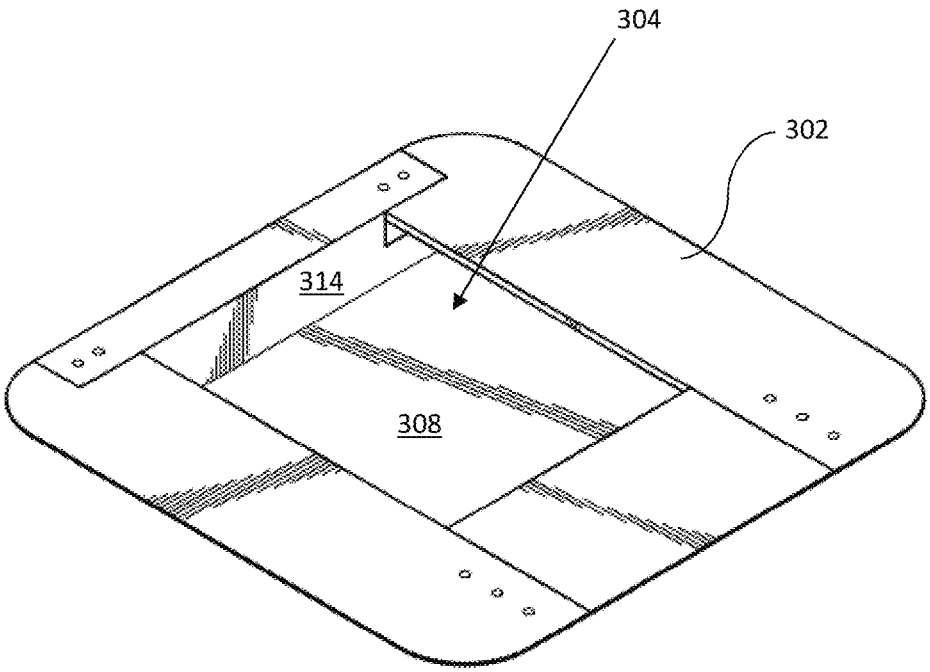
FIG. 3B is a bottom perspective view of a concealed roof vent.
Figure 3C:
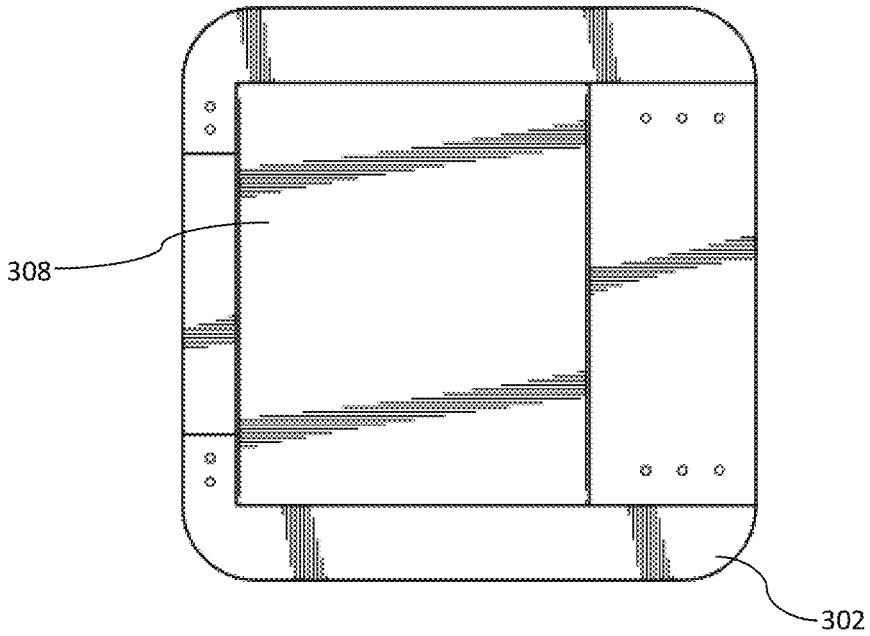
FIG. 3C is a top plan view of a concealed roof vent.
Figure 3D:
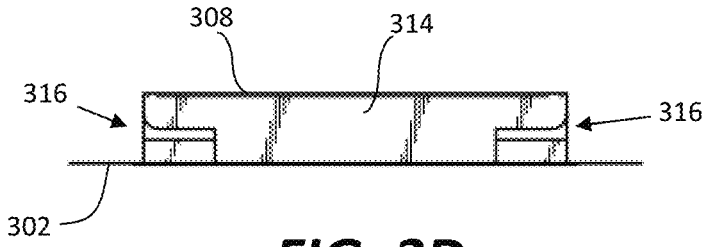
FIG. 3D is a front elevation view of a concealed roof vent.
Figure 3E:
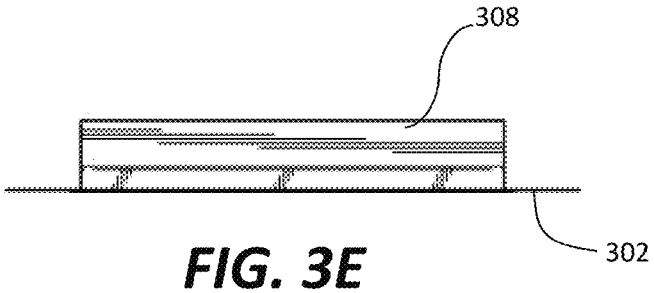
FIG. 3E is a rear elevation view of a concealed roof vent.
Figure 3F:
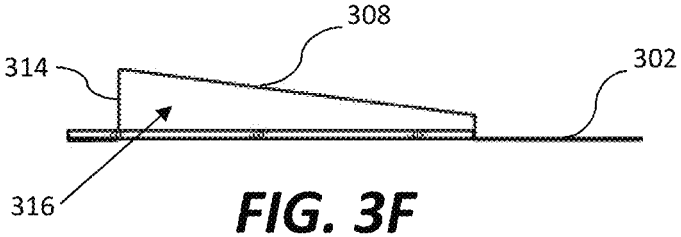
FIG. 3F is a side elevation view of a concealed roof vent.
Figure 3G:
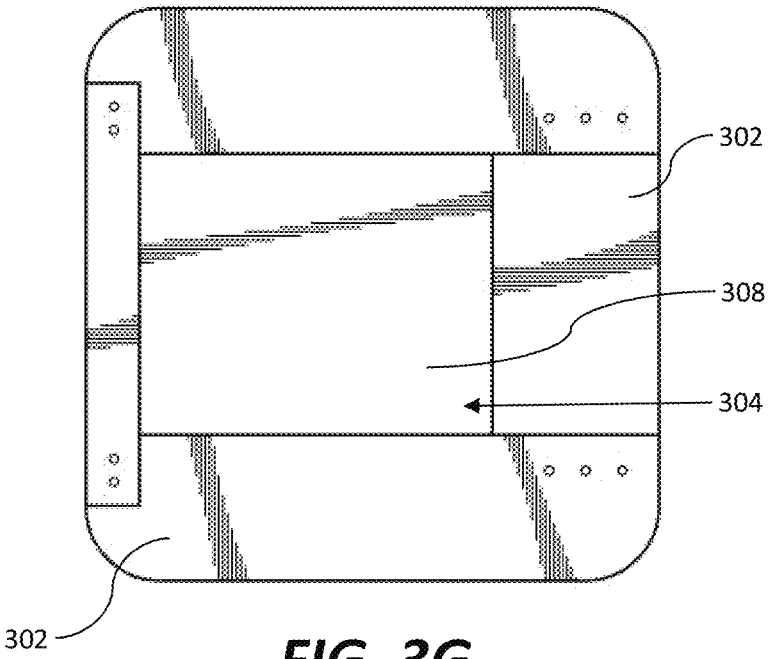
FIG. 3G is a bottom plan view of a concealed roof vent.

In one embodiment, as generally shown in FIGS. 1A-1F, a concealed roof vent 100 comprises a base member 102 having a primary aperture 104, wherein a screen 106 is fastened to a first side of the base member 102 and configured to cover the primary aperture 104. The screen 106 may be coupled to either the first (bottom) side or a second (top) side of the base member 102. As an example, the base member 102 may be formed from a single sheet of material (e.g., aluminum sheeting) with the primary aperture 104 being cut-out therefrom. However, the base member 102 may also be formed by securing (such as by using screws, rivets, or any other suitable connecting means) one or more base panels of material (e.g., wide strips of aluminum sheeting) to each other configured to create an aperture in the center thereof. The concealed roof vent 100 further comprises a top panel 108 coupled toward the rear side 110 of the base member 102 and extending to the front side 112 of the base member 102 at an increasing angle (as best shown in FIG. 1E), the top panel 108 sized so as to shield the primary aperture 104. In other words, the top panel 108 rests about flush with the base member 102 on the rear side 110 and extends to the front side 112 where it is coupled to, and elevated by, one or more support legs 114. The angle of the top panel 108 creates a space around the front and sides between the top panel 108 and the base member 102. This space allows for the flow of air. However, it will be appreciated that while space may exist around the non-connected sides of the top panel 108, only an air space (secondary aperture 116) at the front side 112 of the concealed roof vent 100 is necessary. Further, one or more louvres 118 may be interposed between the extension legs 114 so as to allow air to pass therethrough while restricting unwanted moisture and debris. In one embodiment, the concealed roof vent 100 is manufactured from aluminum, plastics, steel or other metals, or materials that are not susceptible to corrosion and that can withstand extreme weather temperatures. Further, in one embodiment, moisture apertures 120 allow moisture to pass through the concealed vent 100, to prevent buildup of moisture and thereby reduce the risk of moisture damage to the roof. While the Figures generally illustrate two moisture apertures 120, it will be appreciated that any number of moisture apertures may be used.

FIGS. 2A-2F illustrate an alternate embodiment of a concealed roof vent 200 wherein the top panel may be divided into three top members 208A, 208B, and 208C, which are supported by support legs 214. Further, the primary aperture may be divided into three primary apertures 204A, 204B, and 204C that are underneath the three top members 208A, 208B, and 208C, respectively. Each top member 208A, 208B, and 208C has a moisture aperture 220A, 220B therebetween with a corresponding barrier 222A, 222B in the base member 202. The screen 206 may extend about the entire length of the base member 202, covering all primary apertures 204A, 204B, and 204C. The screen 206 is meant to prevent debris and other unwanted items from entering the attic, while still allowing air to flow therethrough. However, it will be appreciated that a screen is not required.

In one embodiment, as generally shown in FIGS. 3A-G, a concealed roof vent 300 comprises a top panel 308 having a support leg 314 formed therefrom. In other words, top panel 308 may be an aluminum sheet that is bent at a front end so as to create the support leg 314. As shown, the support leg 314 does not fully extend the width of the top panel 308, creating secondary apertures 316 along the sides and edges of the top panel 308. Further, it will be appreciated that while the base member 302 is shown as more than one member secured together (e.g., by using rivets), the base member 302 may also be formed from one solid sheet with a primary aperture 304 cut therein. While FIG. 3B does not illustrate a screen covering the primary aperture 304, a screen may be fastened to either the bottom side or top side of the base 302 to cover the primary aperture 304 for the purpose of preventing debris from entering therein while still allowing air to pass therethrough.

Figure 4:
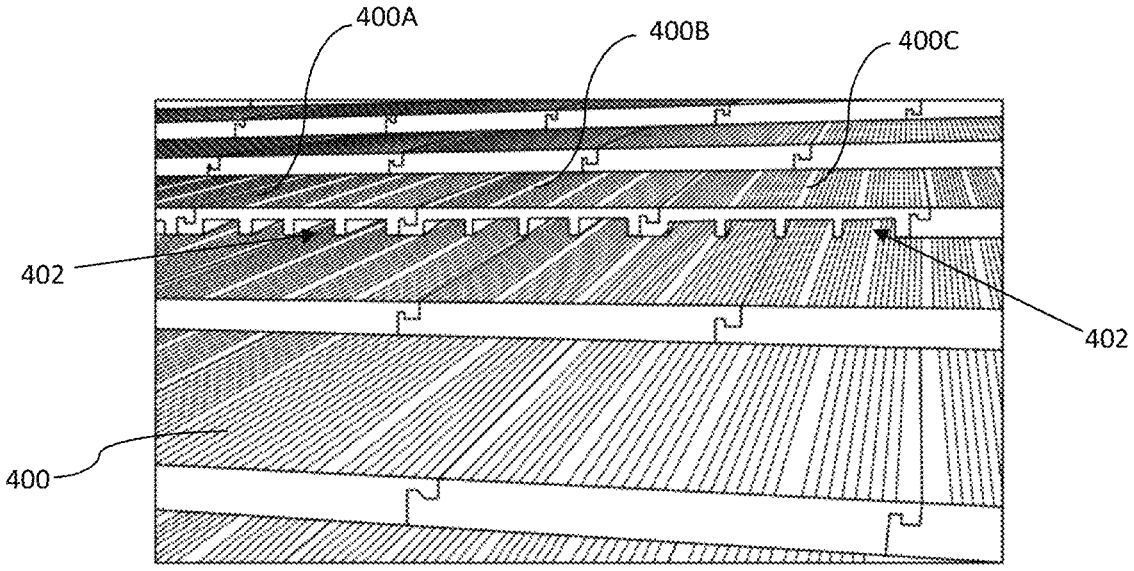
FIG. 4 illustrates the configuration of roof tiles concealing a concealed roof vent.
Figure 5:
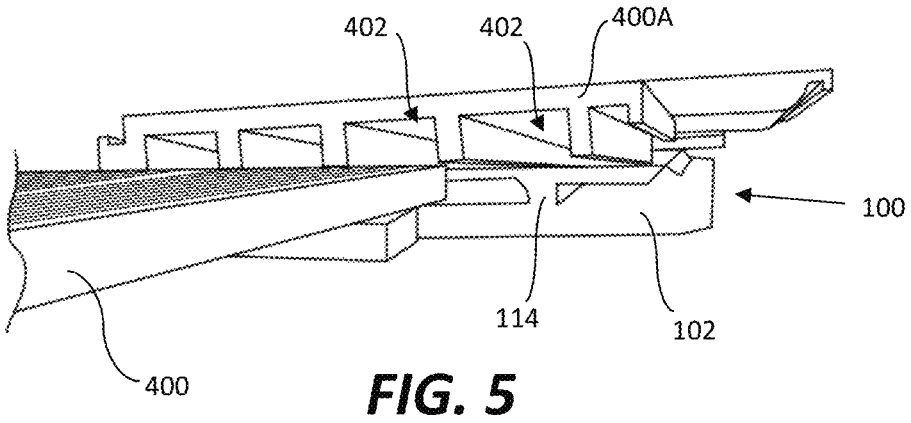
FIG. 5 illustrates a concealed roof vent under a roof tile.
Figure 6:
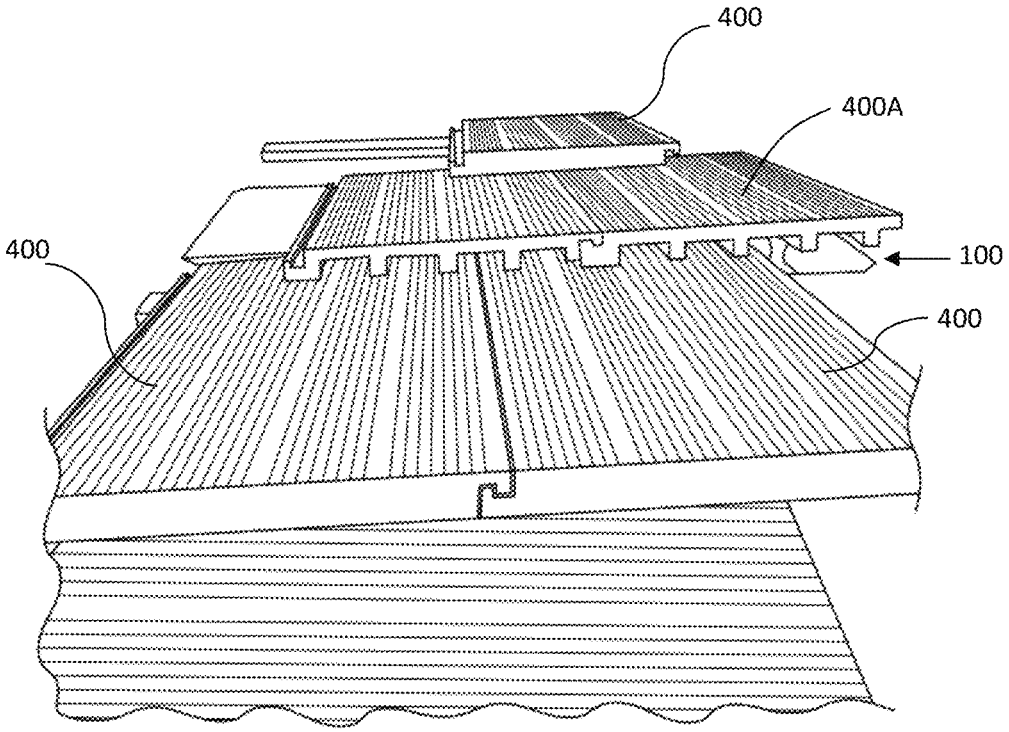
FIG. 6 illustrates a configuration of roof tiles over a concealed roof vent.
Figure 7:
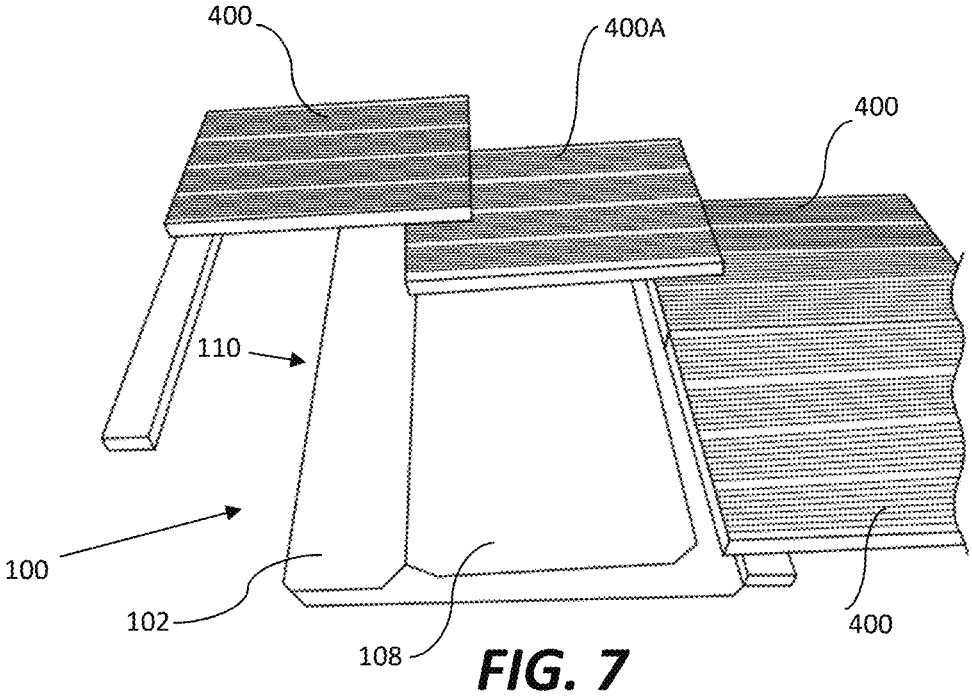
FIG. 7 is a top, side view illustrating the configuration of roof tiles concealing a concealed roof vent.

FIGS. 4-7 show, generally, a system and method of concealing a vent in a roof. FIG. 4 shows the configuration of roof tiles 400, wherein at least one tile 400A-C has channels 402 on the underside for the purpose of allowing air to flow to the concealed air vent beneath the tile. As illustrated and understood, the concealed vent underneath tiles 400A-C is not visible (i.e., completely concealed). This overcomes the main problem in the prior art of the vent being exposed. FIGS. 5-7 illustrate how the vent is placed under the tiles to achieve an efficient venting system, despite being fully concealed.

In FIG. 5, the concealed roof vent 100 is shown beneath tile 400A having channels 402 therein. In FIG. 6, it is understood that the surrounding tiles 400 need not have channels and that the tiles with channels are placed over the concealed vent. It will be appreciated that the method, tiles, and configuration of placing the roof tiles on the roof is the same as those tiles and methods known in the industry, and that the only required modification required are the tiles that are placed over the concealed roof vents described herein—the tiles being modified to have one or more channels on an underside to facilitate the passage of air therethrough to the concealed roof vent there-below. FIG. 7 shows a top, perspective view of the configuration of the tiles. As understood, tile 400A has channels on its underside and is therefore placed atop the concealed vent 100. The concealed vent 100 is placed with the rear side 110 at a higher pitch and covering an aperture into the attic. As such, air is able to flow from the attic, through the aperture in the roof, through the screen and primary aperture of the concealed vent, up through one or more secondary vents, and out through the channels in the tile. It will be appreciated that the tiles may be formed with grooves in them during manufacturing, or may be ground or cut into the tile by a tradesman.

It will be appreciated that while the drawings illustrate flat tiles, the concealed roof vent disclosed herein may also be used with various types of tiles. For example, an S-type tile may have a modified underside so as to create an aperture (or channel) to allow the passage of air. The S-type tile may be either manufactured for such a purpose, or a user may simply grind away part of the tile(s) as needed for the relevant ventilation. As in prior embodiments, a concealed roof vent may be placed beneath one or more S-tiles, allowing the passage of air from the attic to the atmosphere.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention as defined in the appended claims. Additionally, it is not intended that the scope of patent protection afforded the present invention be defined by reading into any claim a limitation found herein that does not explicitly appear in the claim itself.

What is claimed is:

1. A system of concealing roof vents, the system comprising:

at least one tile having at least one channel on an underside of the at least one tile, the at least one tile being placed over a roof vent so as to completely conceal the roof vent from view, the at least one channel of the at least one tile resting directly on the roof vent, the at least one tile remaining flush with adjacent tiles not having channels in a same row;

the at least one tile further comprising a base member circumscribing a primary aperture;

a top panel coupled to a rear side of the base member and extending to a front side of the base member at an increasing angle, wherein the increasing angle of the top panel creates at least one secondary aperture between the top panel and the base member, the top panel sized so as to shield the primary aperture; the top panel being coupled to the front side of the base member using at least one support leg; wherein air passes through an aperture in a roof, through the primary aperture, through the at least one secondary aperture, and through the at least one channel in the at least one tile.

* * * * *